US010116080B1

(12) United States Patent
Ju et al.

(10) Patent No.: US 10,116,080 B1
(45) Date of Patent: Oct. 30, 2018

(54) ELECTRICAL CONNECTOR AND ELECTRONIC DEVICE

(71) Applicant: LOTES CO., LTD, Keelung (TW)

(72) Inventors: Ted Ju, Keelung (TW); Jun Wang, Keelung (TW); Chang Wei Huang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/869,711

(22) Filed: Jan. 12, 2018

(30) Foreign Application Priority Data

Jul. 14, 2017 (CN) ..... 2017 1 0575590

(51) Int. Cl.

| | |
|---|---|
| ***H01R 13/40*** | (2006.01) |
| ***H01R 13/24*** | (2006.01) |
| ***H01R 12/71*** | (2011.01) |
| ***H01R 12/70*** | (2011.01) |
| ***H01R 12/57*** | (2011.01) |
| ***H01R 13/646*** | (2011.01) |

(Continued)

(52) U.S. Cl.
CPC ..... *H01R 13/2457* (2013.01); *H01R 12/57* (2013.01); *H01R 12/714* (2013.01); *H01R 13/2492* (2013.01); *H01R 13/40* (2013.01); *H01R 13/6461* (2013.01); *H01R 12/716* (2013.01); *H01R 13/2435* (2013.01)

(58) Field of Classification Search
CPC H01R 12/714; H01R 23/722; H01R 13/2435; H01R 12/52; H01R 12/57; H01R 12/716; H01R 13/646; H01R 13/7082; H05K 7/1069
See application file for complete search history.

(56) References Cited

U.S. PATENT DOCUMENTS 5,997,315 A * 12/1999 Akama ..... H01R 13/2442 439/326
6,176,707 B1 * 1/2001 Neidich ..... H01R 13/2435 439/66

(Continued)

FOREIGN PATENT DOCUMENTS

CN 2687871 Y 3/2005
CN 2770129 Y 4/2006

(Continued)

*Primary Examiner* — Briggitte R Hammond

(74) *Attorney, Agent, or Firm* — Locke Lord LLP; Tim Tingkang Xia, Esq.

(57) ABSTRACT

An electrical connector includes: an insulating body having multiple accommodating holes; and multiple terminals accommodated in the accommodating holes. Each terminal has a base portion. An elastic arm bends upward and extends from the base portion. A contact portion bends and extends from the elastic arm. A width of the contact portion is greater than a width of the elastic arm at a bending portion connecting the elastic arm to the base portion, which is less than or equal to widths of the remaining portions of the elastic arm. A first urging portion bends downward and extends from the contact portion. A bending arm bends and extends from a lower end of the base portion. The bending arm bends to form a conductive portion. The conductive portion bends upward and extends to form a second urging portion. The first urging portion urges against the second urging portion.

15 Claims, 16 Drawing Sheets

(51) Int. Cl.
*H01R 12/52* (2011.01)
*H01R 13/6461* (2011.01)

(56) References Cited

U.S. PATENT DOCUMENTS 6,186,797 B1 * 2/2001 Wang ..... H01R 13/2435 439/66
6,227,869 B1 * 5/2001 Lin ..... H05K 7/1069 439/515
7,052,284 B2 * 5/2006 Liao ..... H01R 13/2435 439/66
7,134,880 B2 * 11/2006 Arai ..... H01R 13/2435 439/66
7,390,195 B2 * 6/2008 Liao ..... H01R 13/2435 439/66
7,402,049 B2 * 7/2008 Polnyi ..... H01R 12/714 439/66
7,559,811 B1 * 7/2009 Polnyi ..... H01R 4/4809 439/591
7,621,755 B2 * 11/2009 Kubo ..... H01R 13/2435 439/66
2005/0174746 A1 * 8/2005 Hsiao ..... H01R 13/2435 361/769
2009/0035995 A1 * 2/2009 Chang ..... H01R 13/2492 439/630

FOREIGN PATENT DOCUMENTS

CN 2770130 Y 4/2006
CN 2874828 Y 2/2007
CN 2917029 Y 6/2007
CN 201097405 Y 8/2008
CN 201204303 Y 3/2009
CN 201323364 Y 10/2009
CN 106463873 A 2/2017

* cited by examiner

2

2

2

2

2

ELECTRICAL CONNECTOR AND ELECTRONIC DEVICE

CROSS-REFERENCE TO RELATED PATENT APPLICATION

This application claims priority to and the benefit of, pursuant to 35 U.S.C. § 119(a), patent application Serial No. CN201710575590.4 filed in China on Jul. 14, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates an electrical connector and an electronic device, and in particular, to an electrical connector in which each terminal may stably form multiple conductive paths, and an electronic device.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent Application No. CN200320123494.X discloses a socket connector, including an insulating body and a conductive terminal accommodated in the insulating body. The conductive terminal is provided with a main body, a first extending portion and a second extending portion that extend from two ends of the main body, and a first contact portion and a second contact portion that are respectively connected to the first extending portion and the second extending portion. Ends of the first contact portion and the second contact portion are further respectively provided with a first elastic arm and a second elastic arm. When the socket connector is stably connected to a chip module and a circuit board, the first extending portion and the second extending portion are elastically deformed, and the first elastic arm and the second elastic arm are also elastically deformed and are in contact with each other, so as to form a first conductive path starting from the first contact portion, the first extending portion, the main body, the second extending portion, and the second contact portion and finally reaching a corresponding conductor of the circuit board, and a second conductive path starting from the first contact portion, the first elastic arm, the second elastic arm, and the second contact portion and finally reaching a corresponding conductor of the circuit board. Therefore, the socket connector is well electrically connected to the chip module and the circuit board.

However, widths of the first extending portion and the second extending portion are increasingly narrow along the extending directions of the first extending portion and the second extending portion respectively. This limits a width of the contact portion, which results in an urging area between the contact portion and the chip module or the circuit board being small, thus being unfavorable for the terminal to be in stable contact with the chip module and the circuit board. Further, it makes an impedance of the conductive terminal relatively large, which is unfavorable for signal transmission.

Therefore, a heretofore unaddressed need to design an improved electrical connector and an electronic device exists in the art to address the aforementioned deficiencies and inadequacies.

SUMMARY

In view of the problem addressed in the background technology, an objective of the present invention is to provide an electrical connector and an electronic device in which a terminal impedance thereof is reduced.

To achieve the foregoing objective, the present invention adopts the following technical means. An electrical connector for electrically connecting a mating element and an electronic element includes: an insulating body, provided with a plurality of accommodating holes; and a plurality of terminals, respectively and correspondingly accommodated in the accommodating holes. Each of the terminals has: a base portion; a strip connecting portion formed by extending vertically upward from the base portion, and configured to connect to a strip; an elastic arm formed by bending in an upward direction and extending from the base portion; a contact portion formed by bending and extending from the elastic arm, and configured to urge upward against the mating element, wherein the width of the contact portion is greater than the width of the elastic arm at a bending portion connecting the elastic arm to the base portion, the width of the elastic arm at the bending portion between the elastic arm and the base portion is less than or equal to the widths of the remaining portions of the elastic arm, and a first urging portion is formed by bending and extending from the contact portion; and a bending arm formed by bending in a downward direction and extending from the base portion, wherein the bending arm bends to form a conductive portion configured to be conductively connected to the electronic element, the conductive portion bends upward and extends to form a second urging portion, and the first urging portion urges against the second urging portion.

In certain embodiments, the electrical connector includes two strip connecting portions, wherein a top end of each of the two strip connecting portions is higher than the bending portion connecting the elastic arm to the base portion, and the elastic arm is formed by tearing and bending between the two strip connecting portions.

In certain embodiments, the base portion is of a vertical flat plate shape, and has a first section and a second section extending vertically upward from the first section, the first section is connected to the bending arm, the second section is connected to the elastic arm, and a width of the second section is greater than a width of the first section.

In certain embodiments, the bending arm includes: a lower positioning portion formed by bending and extending from the base portion toward a direction away from the conductive portion and then bending and extending reversely, wherein the lower positioning portion stops at a side surface of a corresponding one of the accommodating holes; and a connecting portion formed by extending obliquely downward from the lower positioning portion to be connected to the conductive portion.

In certain embodiments, when the mating element does not press-fit the contact portion, the first urging portion is in contact with the second urging portion.

In certain embodiments, the first urging portion includes a first elastic portion bending from the contact portion and obliquely extending downward and away from the base portion, a second elastic portion obliquely extending downward from the first elastic portion to be close to the base portion, and a third elastic portion bending and extending upward from the second elastic portion to be close to the base portion.

In certain embodiments, a slot runs through the first elastic portion, the second elastic portion and the contact portion.

In certain embodiments, the third elastic portion is not provided with the slot, and the third elastic portion urges against the second urging portion.

In certain embodiments, the slot runs through the third elastic portion.

In certain embodiments, the slot further runs through the base portion and the elastic arm.

In certain embodiments, the slot does not extend to the elastic arm at the bending portion connecting the elastic arm to the base portion.

In certain embodiments, the elastic arm includes: an upper positioning portion formed by bending and extending from the base portion toward a direction away from the contact portion and then bending and extending reversely, wherein the upper positioning portion stops at a side surface of a corresponding one of the accommodating holes; and an extending portion formed by extending obliquely upward from the upper positioning portion to be connected to the contact portion.

In certain embodiments, the bending arm and the elastic arm are symmetrically disposed along a vertical direction, the conductive portion and the contact portion are symmetrically disposed along the vertical direction, and the second urging portion and the first urging portion are symmetrically disposed along the vertical direction.

In certain embodiments, each of two opposite sides of the base portion at a connection portion connecting the base portion to the bending arm is protrudingly provided with a protruding portion, and the protruding portion stops at a side surface of a corresponding one of the accommodating holes.

In certain embodiments, each of the accommodating holes is protrudingly formed with a stopping block, and the stopping block urges against a plate surface of the base portion.

Compared with the prior art, the present invention has the following beneficial effects:

A width of the contact portion is greater than a width of the elastic arm at a bending portion connecting the elastic arm to the base portion, and the width of the elastic arm at the bending portion connecting the elastic arm to the base portion is less than or equal to the widths of the remaining portions of the elastic arm, so as to ensure a relatively large contact area between the contact portion and the mating element, increase stability of the contact portion urging against the mating element, reduce the impedance of the terminals, and ensure signal conduction quality of the terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION

Figure 1:
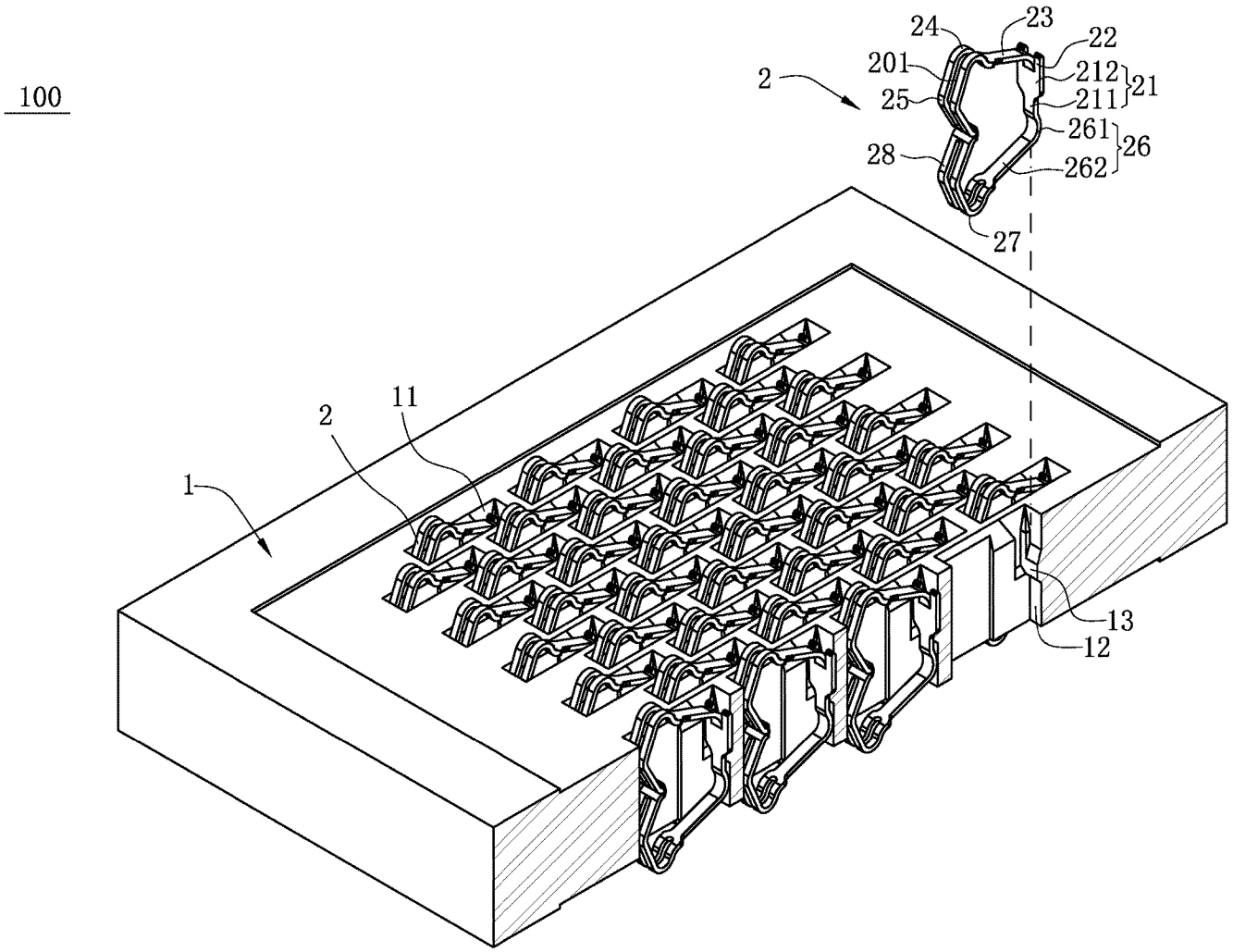
FIG. 1 is a local schematic perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to a method for manufacturing an electrical connector and an electronic device.

Figure 2:
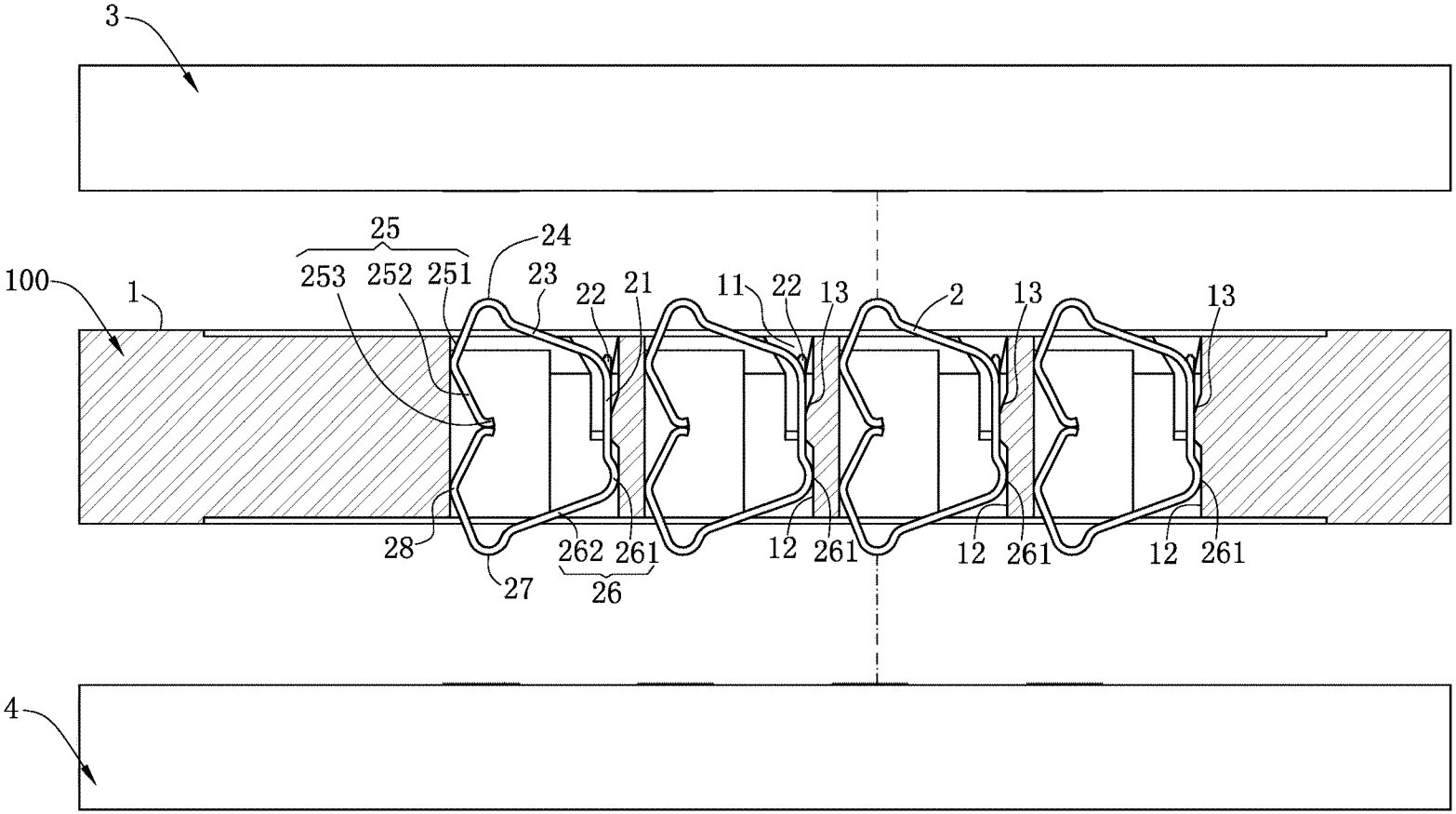
FIG. 2 is a schematic sectional view of the electrical connector according to the first embodiment of the present invention before a mating element mates an electronic element.
Figure 3:
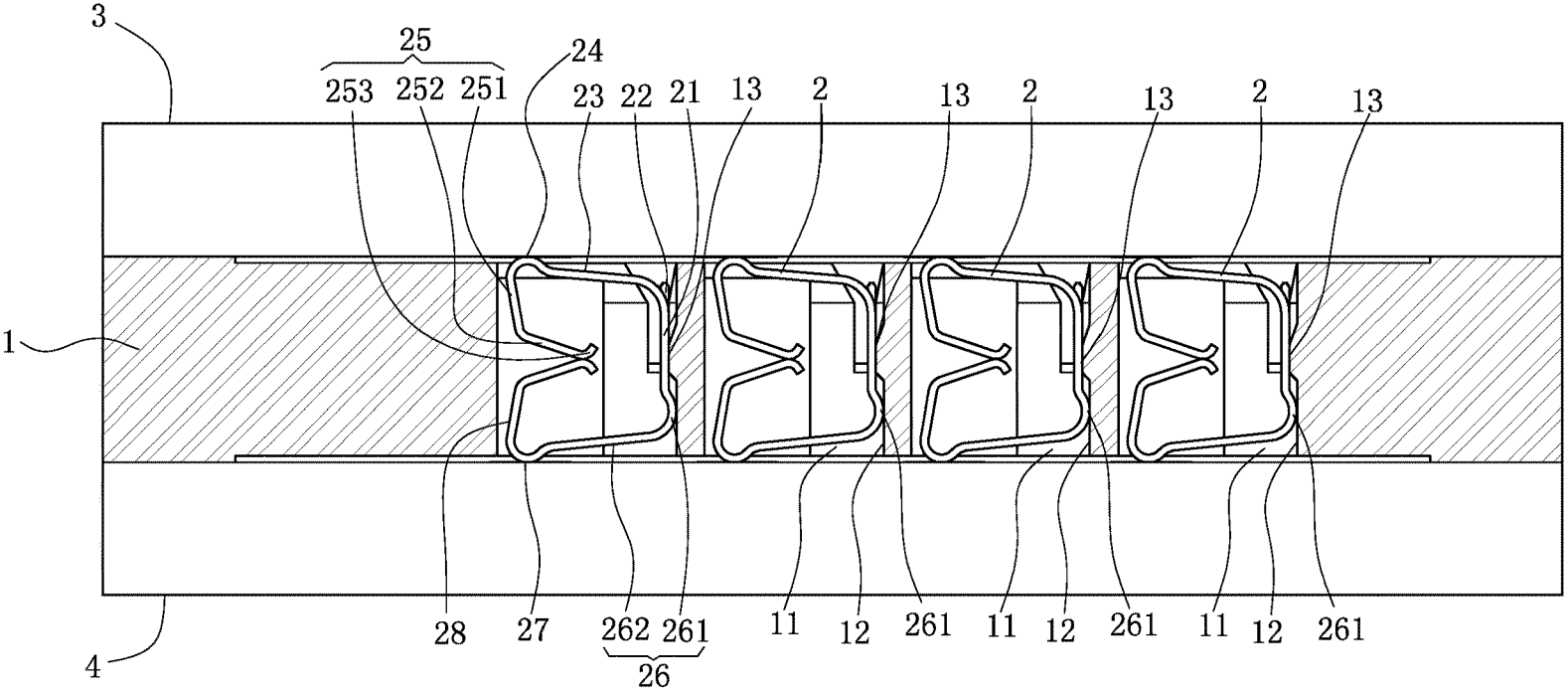
FIG. 3 is a schematic sectional view of the electrical connector according to the first embodiment of the present invention after the mating element mates the electronic element.

As shown in FIG. 1 and FIG. 2, an electrical connector 100 according to a first embodiment of the present invention is provided. The electrical connector 100 of the present invention is used to electrically connect a mating element 3 to an electronic element 4, and includes an insulating body 1 and multiple terminals 2 retained in the insulating body 1. One end of each of the terminals 2 elastically urges against the mating element 3, and another end urges against the electronic element 4. In this embodiment, the mating element 3 is a chip module, and the electronic element 4 is a circuit board. In other embodiments, the types of the mating element 3 and the electronic element 4 are not limited, as long as they can cooperate with the electrical connector 100.

As shown in FIG. 1, the insulating body 1 is provided with multiple accommodating holes 11 arranged in a matrix run through the upper and lower surfaces of the insulating body 1, to respectively and correspondingly accommodate the terminals 2, and each of the accommodating holes 11 is protrudingly formed with a stopping block 13.

Figure 4:
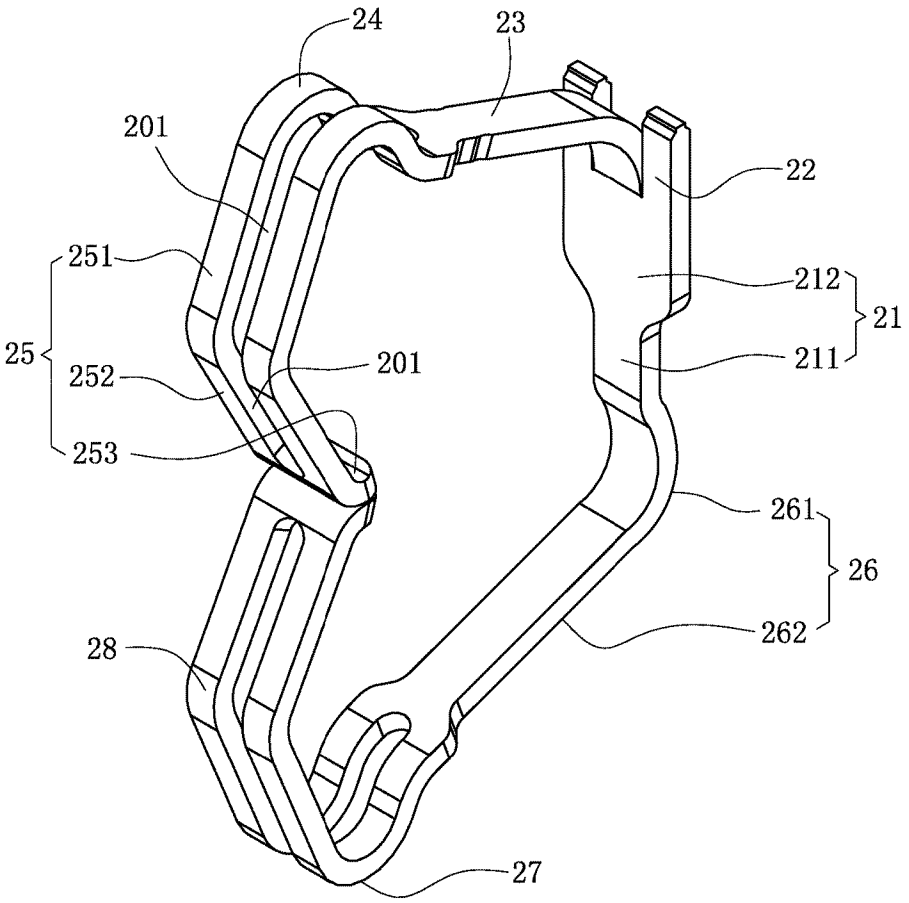
FIG. 4 is a perspective view of a terminal of the electrical connector according to the first embodiment of the present invention.

As shown in FIG. 2 and FIG. 4, the terminal 2 is formed by punching a metal plate material, and has a base portion 21 having a vertical flat plate shape. The stopping block 13 urges against a plate surface of the base portion 21. The base portion 21 has a first section 211 and a second section 212 extending vertically upward from the first section 211, and a width of the second section 212 is greater than a width of the first section 211.

Two strip connecting portions 22 disposed at an interval are formed by extending vertically upward from the second section 212, and are configured to connect to a strip. An elastic arm 23 is formed by bending in an upward direction and extending from the second section 212 and is located between the two strip connecting portions 22. In this embodiment, the elastic arm 23 is formed by tearing and bending between the two strip connecting portions 22. In other embodiments, the elastic arm 23 may not be formed by tearing. A contact portion 24 is formed by bending and extending from the elastic arm 23, and is configured to urge upward against the mating element 3. A width of the contact portion 24 is greater than the width of the elastic arm 23 at the bending portion connecting the elastic arm 23 to the base portion 21, so as to increase the area of the plate surface of the contact portion 24 and further increase the contact area between the contact portion 24 and the mating element 3. In this embodiment, the width of the elastic arm 23 is maintained constant from the bending portion connecting the elastic arm 23 to the base portion 21 along an extending direction the elastic arm 23, and the width of the elastic arm 23 increases only at a connection place connecting the elastic arm 23 to the contact portion 24. In other embodiments, the width of the elastic arm 23 may gradually increase from the bending portion connecting the elastic arm 23 to the base portion 21 to the connection place connecting the elastic arm 23 to the contact portion 24, so as to prevent the width of the elastic arm 23 at the bending portion connecting the elastic arm 23 to the base portion 21 from being excessively large, and ensure that the elastic arm 23 has good elastic performance at the bending portion connecting the elastic arm 23 to the base portion 21. Moreover, the distance between the two strip connecting portions 22 is reduced, so as to reduce the width of the terminal 2, and implement an intensified arrangement of the terminal 2.

A first urging portion 25 is formed by bending downward and extending from the contact portion 24. Further, the first urging portion 25 includes a first elastic portion 251 formed by bending from the contact portion 24 and obliquely extending downward and away from the base portion 21, a second elastic portion 252 formed by obliquely extending downward from the first elastic portion 251 to be close to the base portion 21, and a third elastic portion 253 bending and extending upward from the second elastic portion 252 to be close to the base portion 21. A slot 201 runs through the first elastic portion 251, the second elastic portion 252 and the contact portion 24. In this way, elasticity of the contact portion 24, the first elastic portion 251 and the second elastic portion 252 may increase, and the self-inductance effect in signal transmission of the terminal 2 may be reduced, so as to avoid the crosstalk between neighboring terminals 2, which is favorable for improving high-speed signal transmission of the terminal 2. In another aspect, the setting of the slot 201 increases the conductive path during signal transmission of the terminal 2. Additionally, the slot 201 does not extend to the elastic arm 23 at the bending portion connecting the elastic arm 23 to the base portion 21, so as to prevent the strength of the elastic arm 23 from being excessively low. It should be noted that, in this embodiment, the third elastic portion 253 is not provided with the slot 201, so as to increase the structure stability of the third elastic portion 253.

A bending arm 26 is formed by bending in a downward direction from the first section 211. A conductive portion 27 is formed by bending and extending from the bending arm 26, and is configured to conductively connect to the electronic element 4. A second urging portion 28 is formed by bending upward and extending from the conductive portion 27, and the second urging portion 28 urges against the third elastic portion 253, so that the terminals 2 form three conductive paths respectively, including: a conductive path formed by the contact portion 24, the elastic arm 23, the base portion 21, the bending arm 26 and the conductive portion 27; and two conductive paths respectively formed by the contact portion 24, the first elastic portion 251, the second elastic portion 252, the third elastic portion 253, the second urging portion 28 and the conductive portion 27 at two opposite sides of the slot 201. The three conductive paths formed in this way enhance the signal conduction capability of the terminal 2. It should be particularly noted that, regardless of whether the mating element 3 is press-fit to the contact portion 24 to press and deform the elastic arm 23 and the bending arm 26, the second urging portion 28 is always being in contact with the third elastic portion 253, so as to ensure that the conductive path from the second urging portion 28 to the third elastic portion 253 is stable. In this embodiment, the conductive portion 27 and the contact portion 24 are symmetrically disposed along the vertical direction, and the second urging portion 28 and the first urging portion 25 are symmetrically disposed along the vertical direction, so that the terminal 2 has a vertically symmetrical structure and is deformed uniformly when being subject to a force, so as to enhance the fatigue resistance of the terminal 2. Preferably, the bending arm 26 includes a lower positioning portion 261 formed by bending and extending from the base portion 21 toward a direction away from the conductive portion 27 and then bending and extending reversely, where the lower positioning portion 261 stops at a side surface of 12 of the accommodating hole 11 and is located below the stopping block 13, and a connecting portion 262 formed by extending obliquely downward from the lower positioning portion 261 to be connected to the conductive portion 27.

Figure 5:
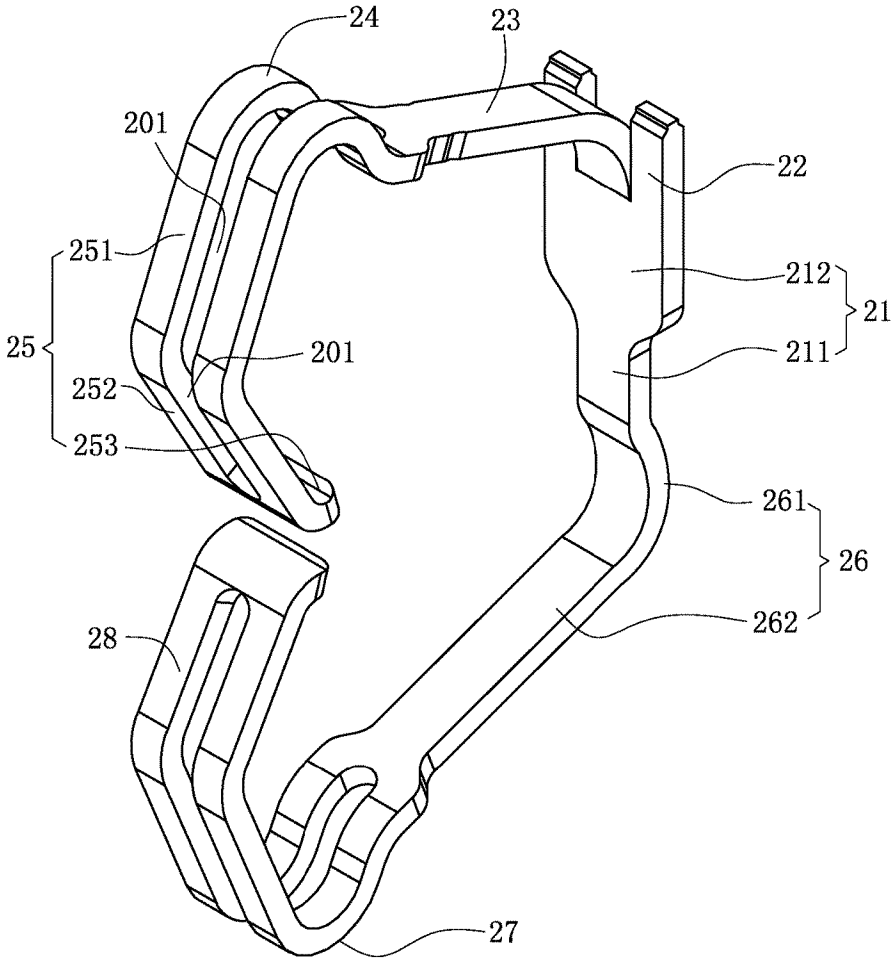
FIG. 5 is a perspective view of a terminal of an electrical connector according to a second embodiment of the present invention.
Figure 6:
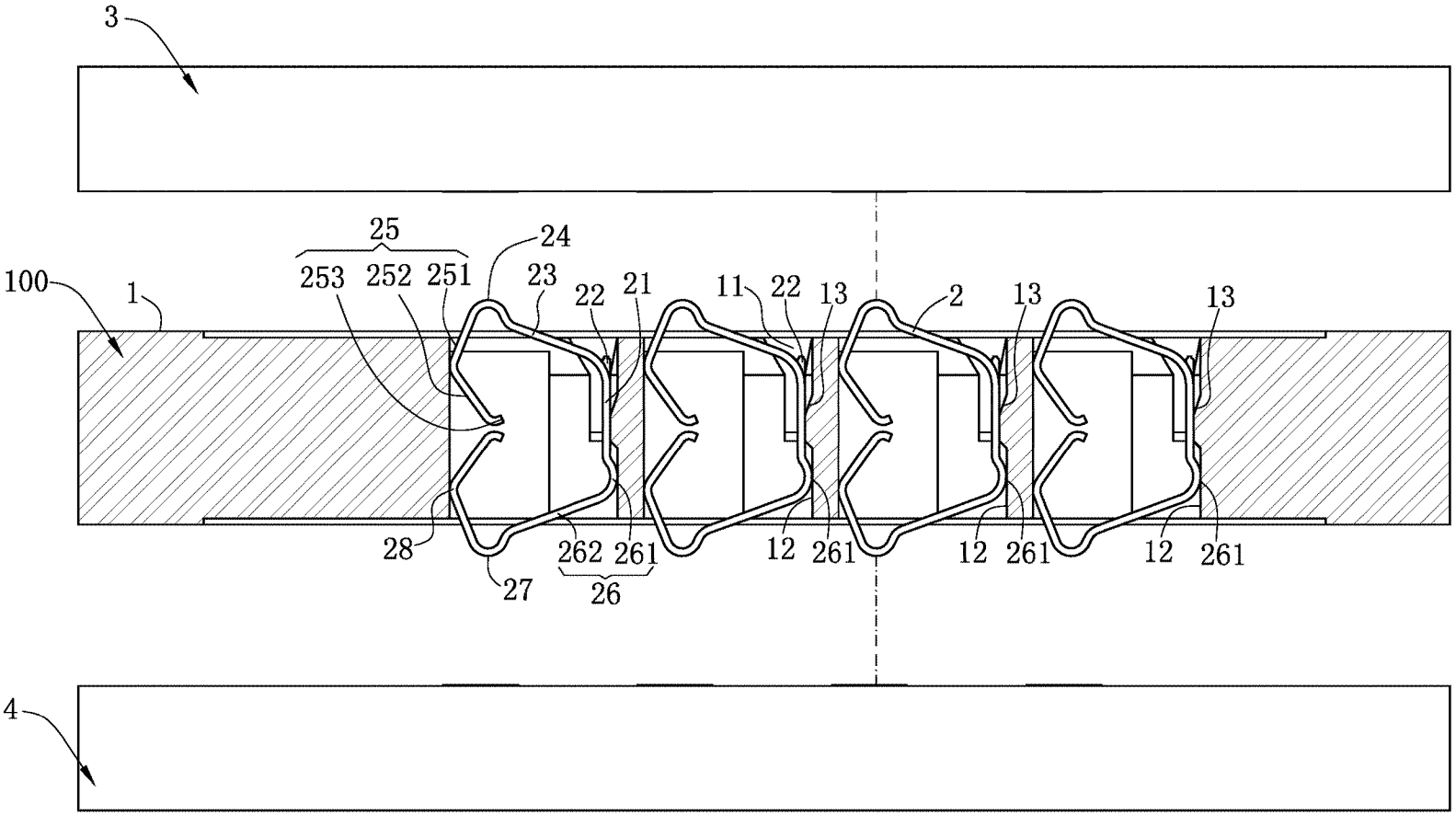
FIG. 6 is a schematic sectional view of the electrical connector according to the second embodiment of the present invention before a mating element mates an electronic element.
Figure 7:
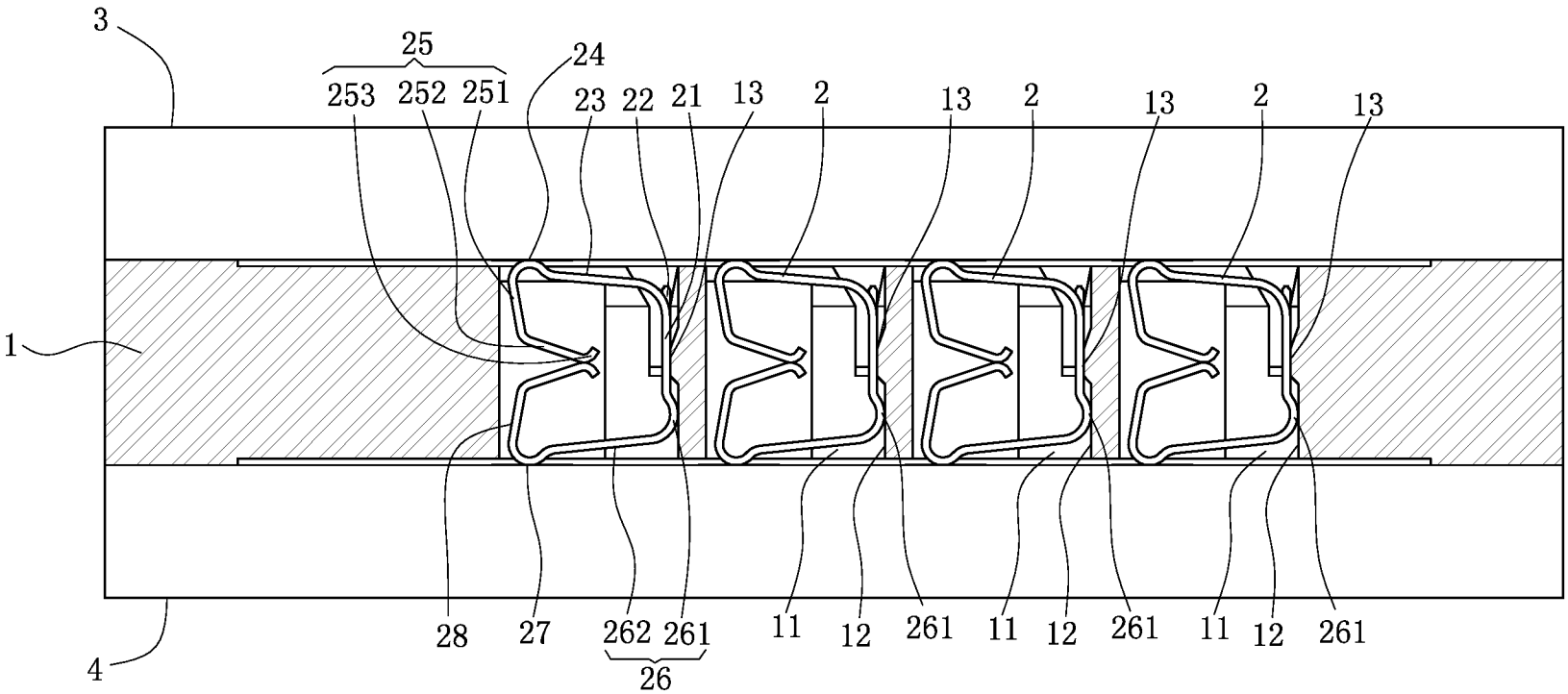
FIG. 7 is a schematic sectional view of the electrical connector according to the second embodiment of the present invention after the mating element mates the electronic element.

As shown in FIG. 5 to FIG. 7, an electrical connector 100 according to a second embodiment of the present invention is provided. The structure of the terminal 2 of this embodiment mainly differs from the structure of the terminal 2 of the first embodiment in that, in this embodiment, before the mating element 3 is press-fit to the contact portion 24 to deform the elastic arm 23 and the bending arm 26, the first urging portion 25 does not urge against the second urging portion 28. When the mating element 3 is pressed against the contact portion 24, the elastic arm 23 and the bending arm 26 are deformed respectively toward the directions to be close to each other, so that the first urging portion 25 urges against the second urging portion 28, thus forming a conductive path. Other structures and functions of the elements of this embodiment are completely consistent with those of the first embodiment, and details are not elaborated herein.

Figure 8:
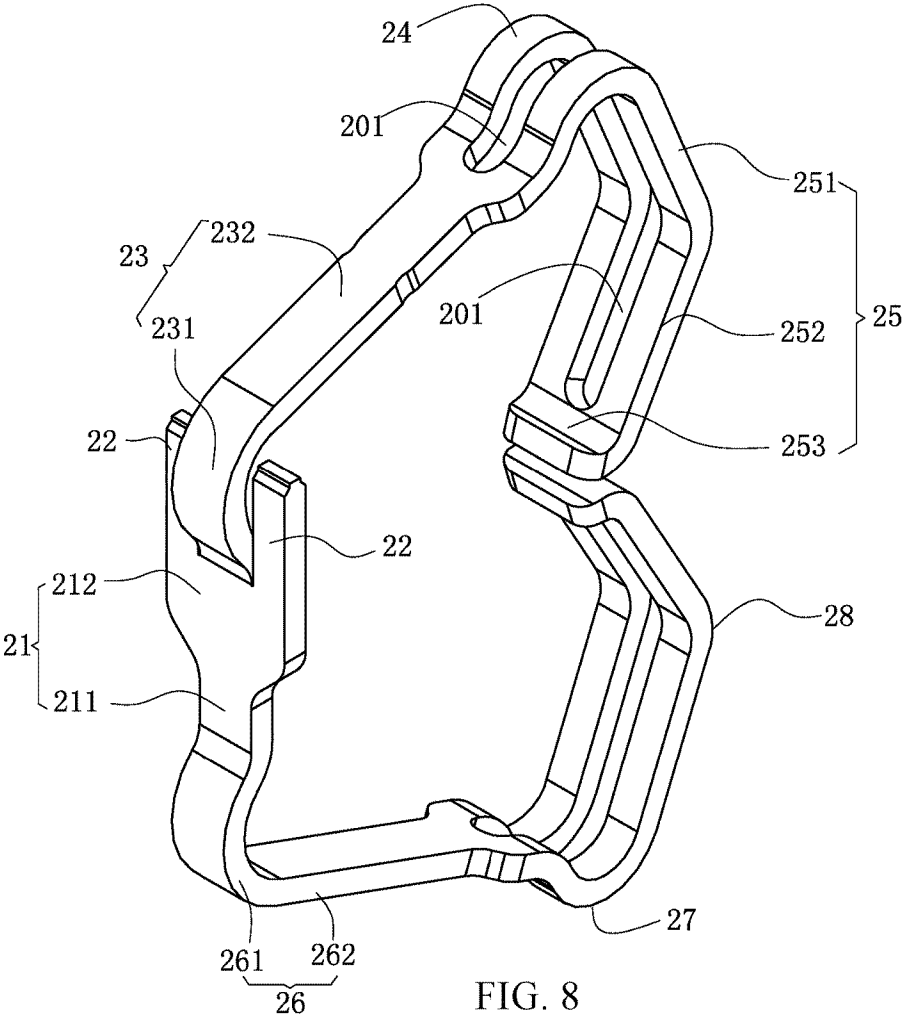
FIG. 8 is a perspective view of a terminal of an electrical connector according to a third embodiment of the present invention.

As shown in FIG. 8, an electrical connector 100 according to a third embodiment of the present invention is provided. The third embodiment mainly differs from the second embodiment in that: the elastic arm 23 includes an upper positioning portion 231 formed by bending and extending from the base portion 21 toward a direction away from the contact portion 24 and then bending and extending reversely, and an extending portion 232 formed by extending obliquely upward from the upper positioning portion 231 to be connected to the contact portion 24. The upper positioning portion 231 and the lower positioning portion 261 are symmetrically disposed along the vertical direction, and both jointly stop by a side surface 12 of the accommodating hole 11, so that the terminal 2 is retained in the insulating body 1. Other structures and functions of this embodiment are completely consistent with those of the second embodiment, and details are not elaborated herein.

Figure 9:
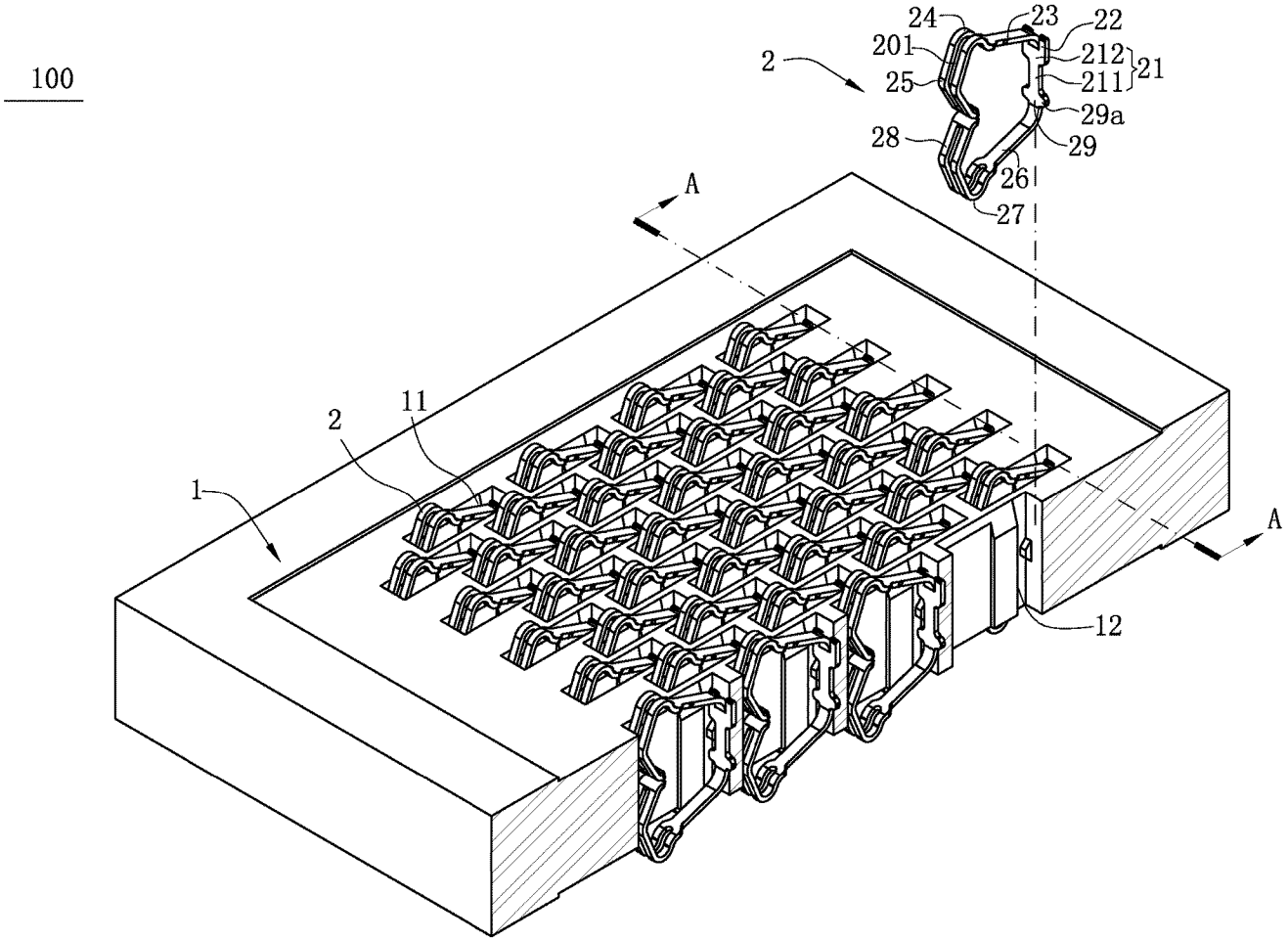
FIG. 9 is a local schematic three-dimensional exploded view of an electrical connector according to a fourth embodiment of the present invention.
Figure 10:
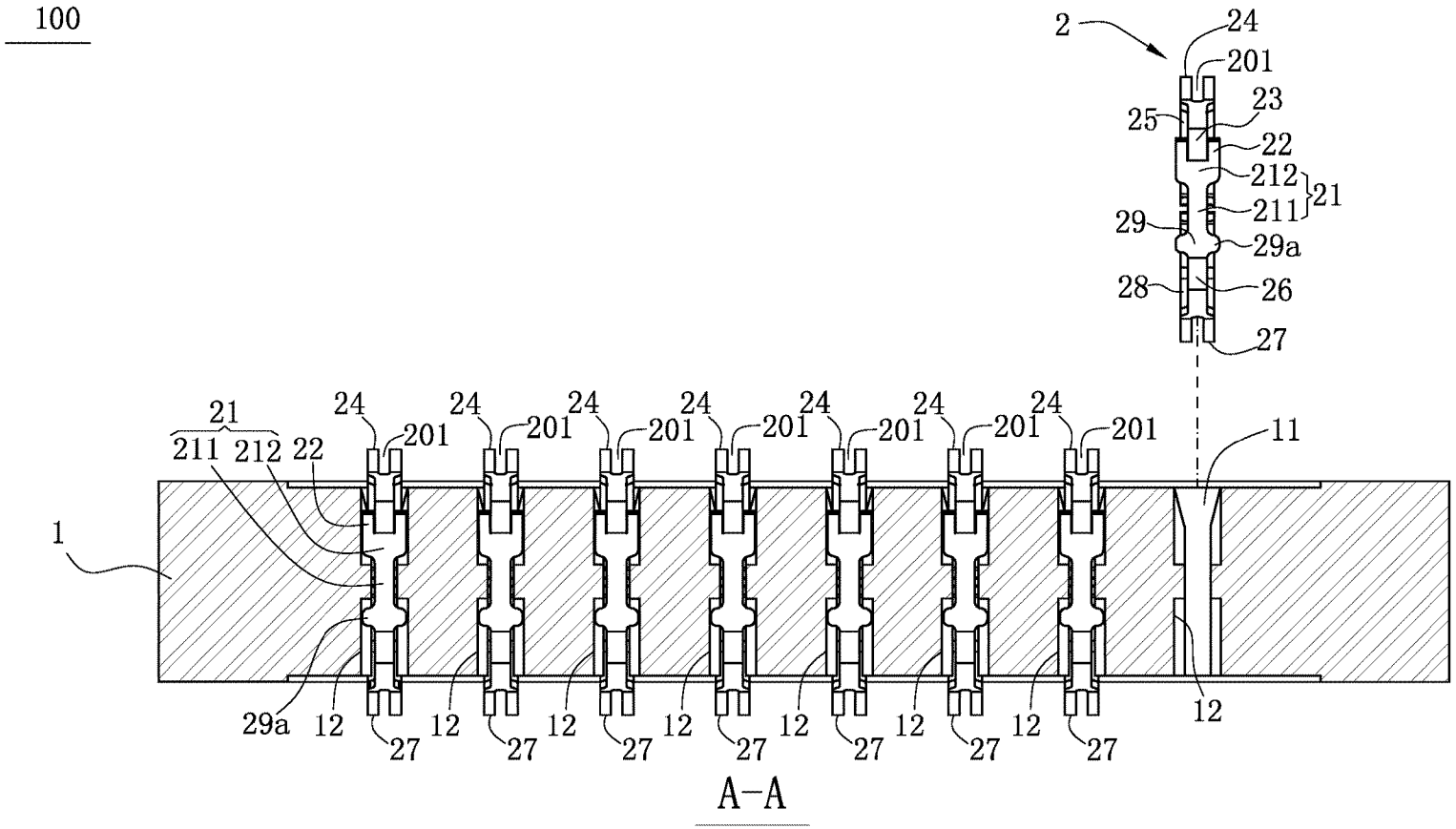
FIG. 10 is a schematic sectional view of the electrical connector according to the fourth embodiment of the present invention along a line A-A.
Figure 11:
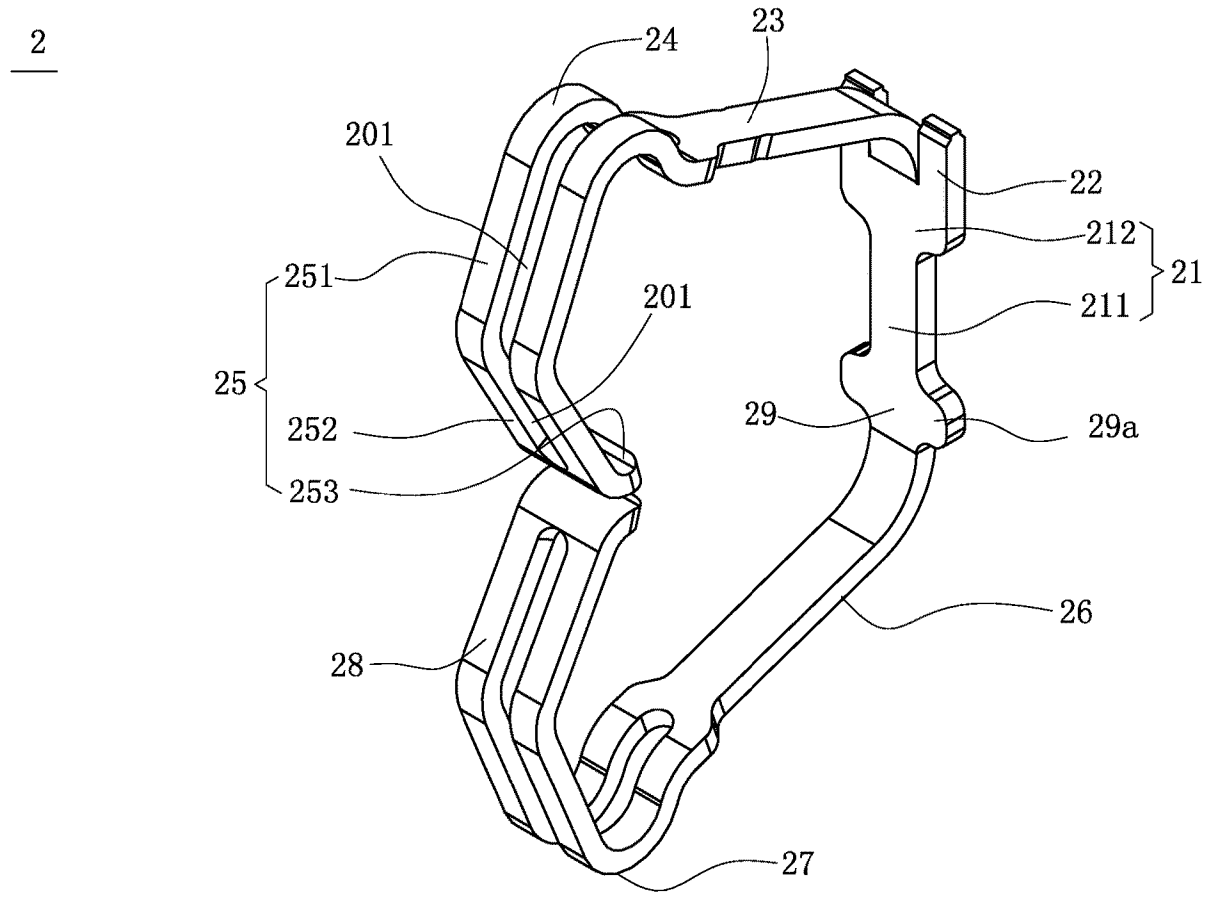
FIG. 11 is a perspective view of a terminal of the electrical connector according to the fourth embodiment of the present invention.

As shown in FIG. 9 to FIG. 11, an electrical connector 100 according to a fourth embodiment of the present invention is shown. The fourth embodiment mainly differs from the second embodiment in that the terminal 2 and the accommodating hole 11 are fixed in different manners. Specifically, in this embodiment, each of two opposite sides of the first terminal 2 at a connection portion 29 connecting the base portion 21 of the first terminal 2 to the bending arm 26 is protrudingly provided with a protruding portion 29*a*, and the protruding portion 29*a* stops by the side surface 12 of the accommodating hole 11, so that the terminal 2 is fixed in the accommodating hole 11. A side edge of the protruding portion 29*a* and a side edge of the strip connecting portion 22 are flush in a vertical direction. Other structures and functions of the elements of this embodiment are completely consistent with those of the second embodiment, and details are not elaborated herein.

Figure 12:
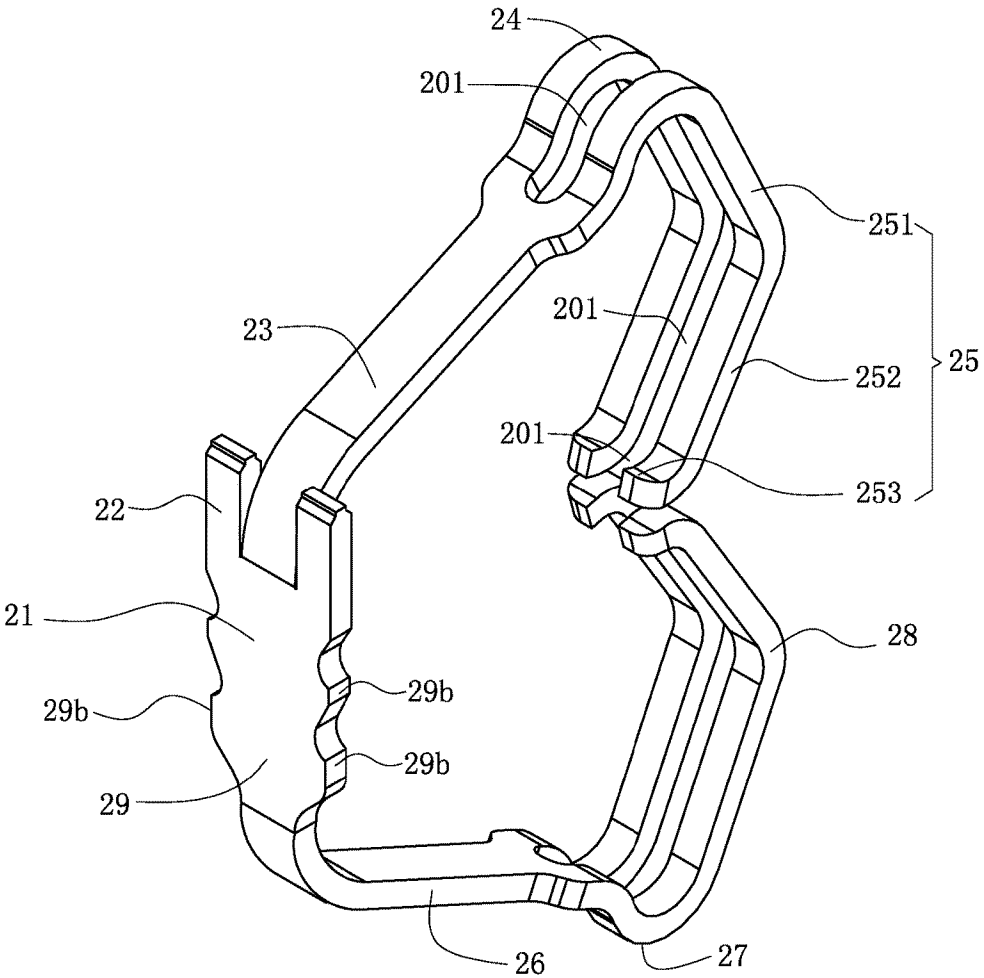
FIG. 12 is a perspective view of a terminal of an electrical connector a fifth embodiment of according to the present invention.
Figure 13:
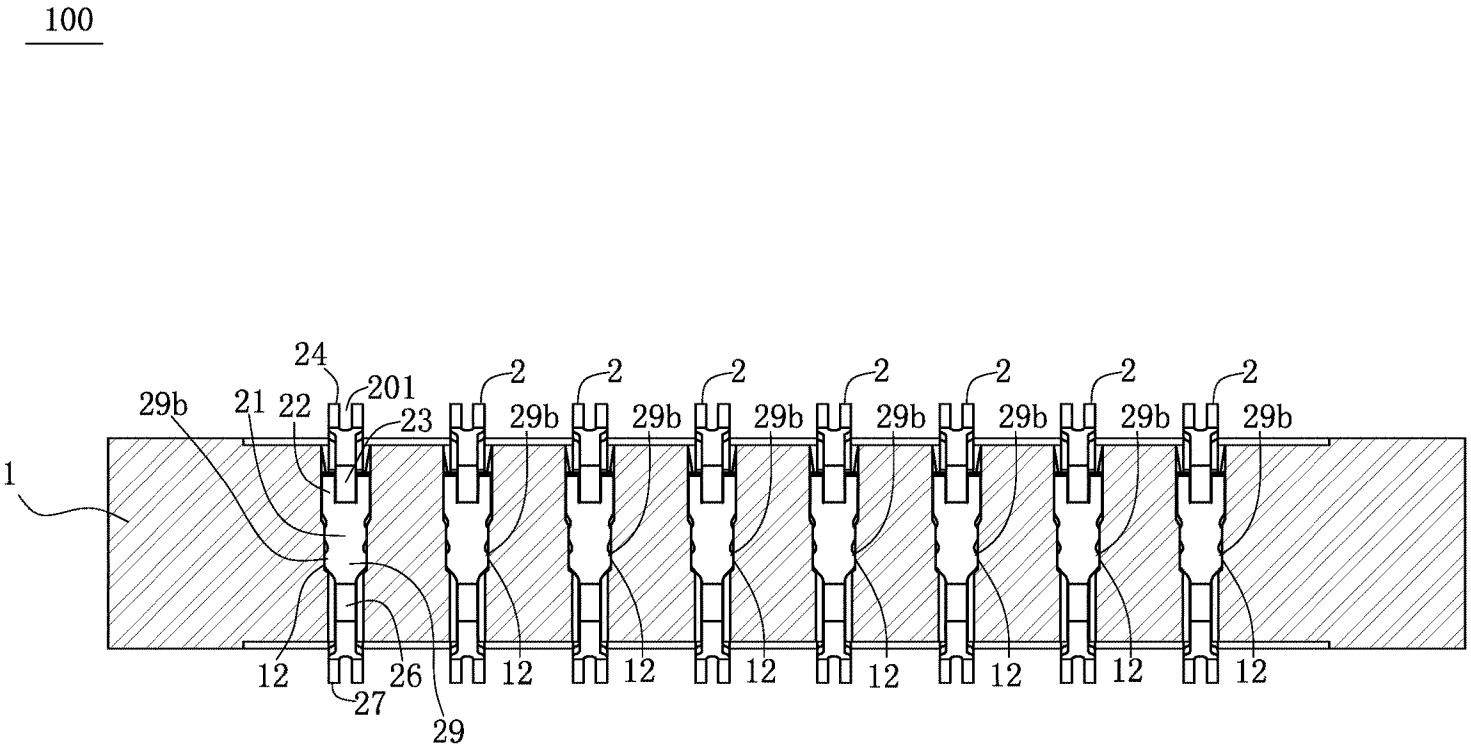
FIG. 13 is a schematic sectional view of the electrical connector the fifth embodiment of according to the present invention.

As shown in FIG. 12 and FIG. 13, an electrical connector 100 according to a fifth embodiment of the present invention is provided. The fifth embodiment mainly differs from the second embodiment in that: the slot 201 extends all through to the third elastic portion 253, dividing the third elastic portion 253 into two parts. Correspondingly, the second urging portion 28 is also divided into two parts, so that when the second urging portion 28 urges against the third elastic portion 253, two conductive paths are added, thereby increasing the signal transmission capability of the terminal 2. Additionally, multiple protruding thorns 29*b* are protrudingly formed from each of two opposite sides of the base portion 21, and the protruding thorns 29*b* and the side surface 12 of the accommodating hole 11 are in an interference fit, so that the terminal 2 is fixed in the accommodating hole 11. Other structures and functions of the elements of this embodiment are completely consistent with those of the second embodiment, and details are not elaborated herein.

Figure 14:
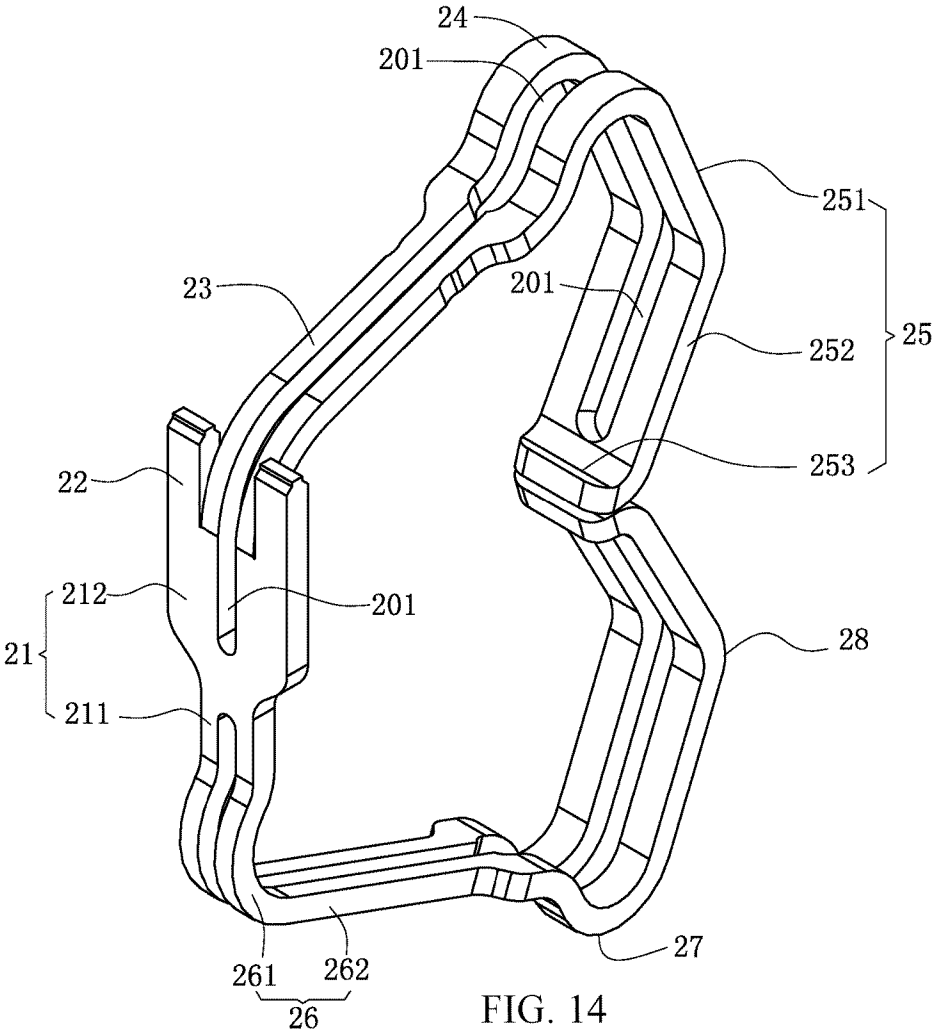
FIG. 14 is a perspective view of a terminal of the electrical connector according to a sixth embodiment of the present invention.

As shown in FIG. 14, an electrical connector 100 according to a sixth embodiment of the present invention is provided. The sixth embodiment mainly differs from the second embodiment in that: the slot 201 further runs through the second section 212 and the elastic arm 23, and correspondingly, another slot 201 runs through the bending arm 26 and the first section 211, so as to further reduce the self-inductance effect of the terminal 2 during signal transmission. In other embodiments, each terminal 2 may not be provided with the slot 201.

Figure 15:
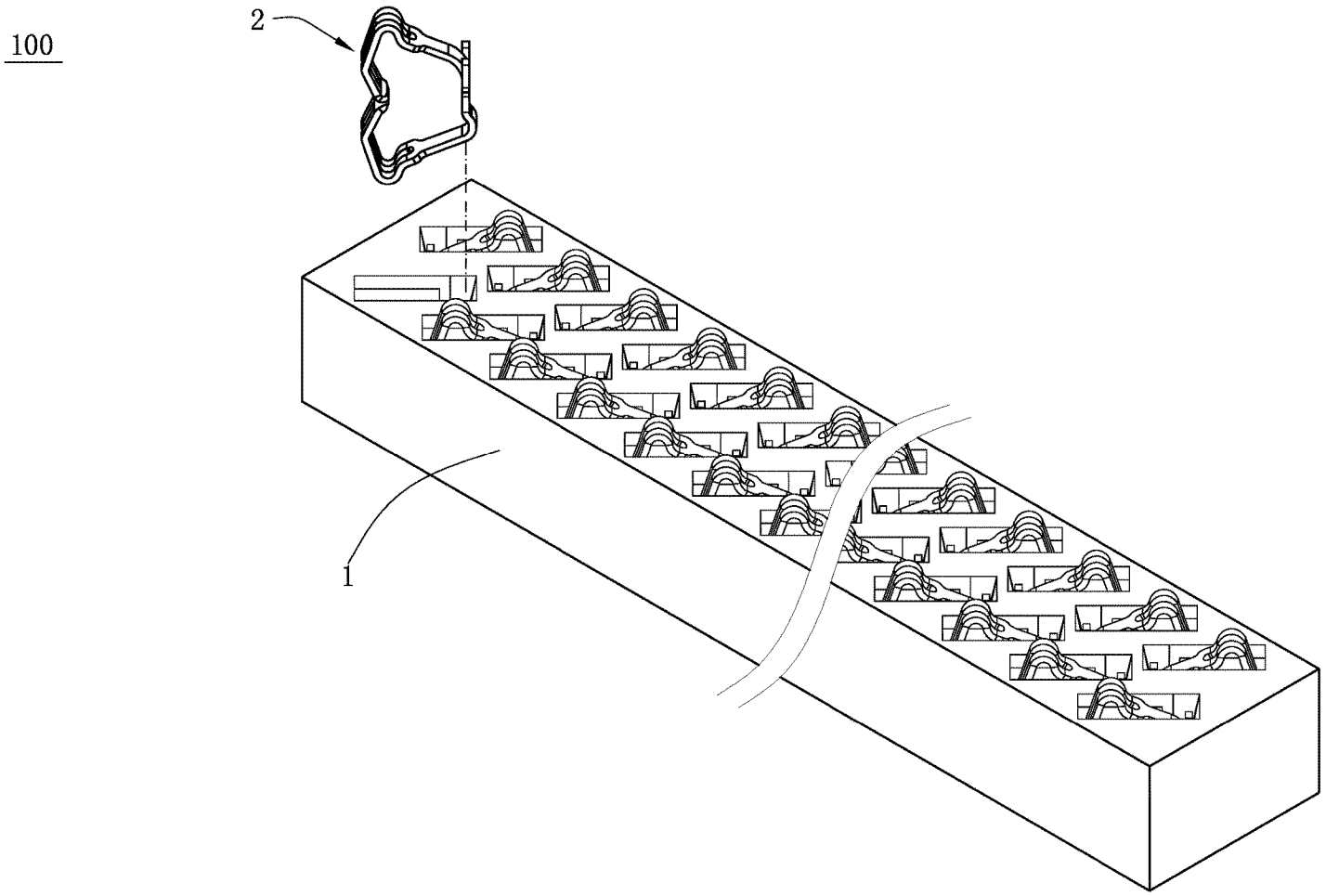
FIG. 15 is a schematic perspective view of an electrical connector according to one embodiment of the present invention applied to an electronic card.
Figure 16:
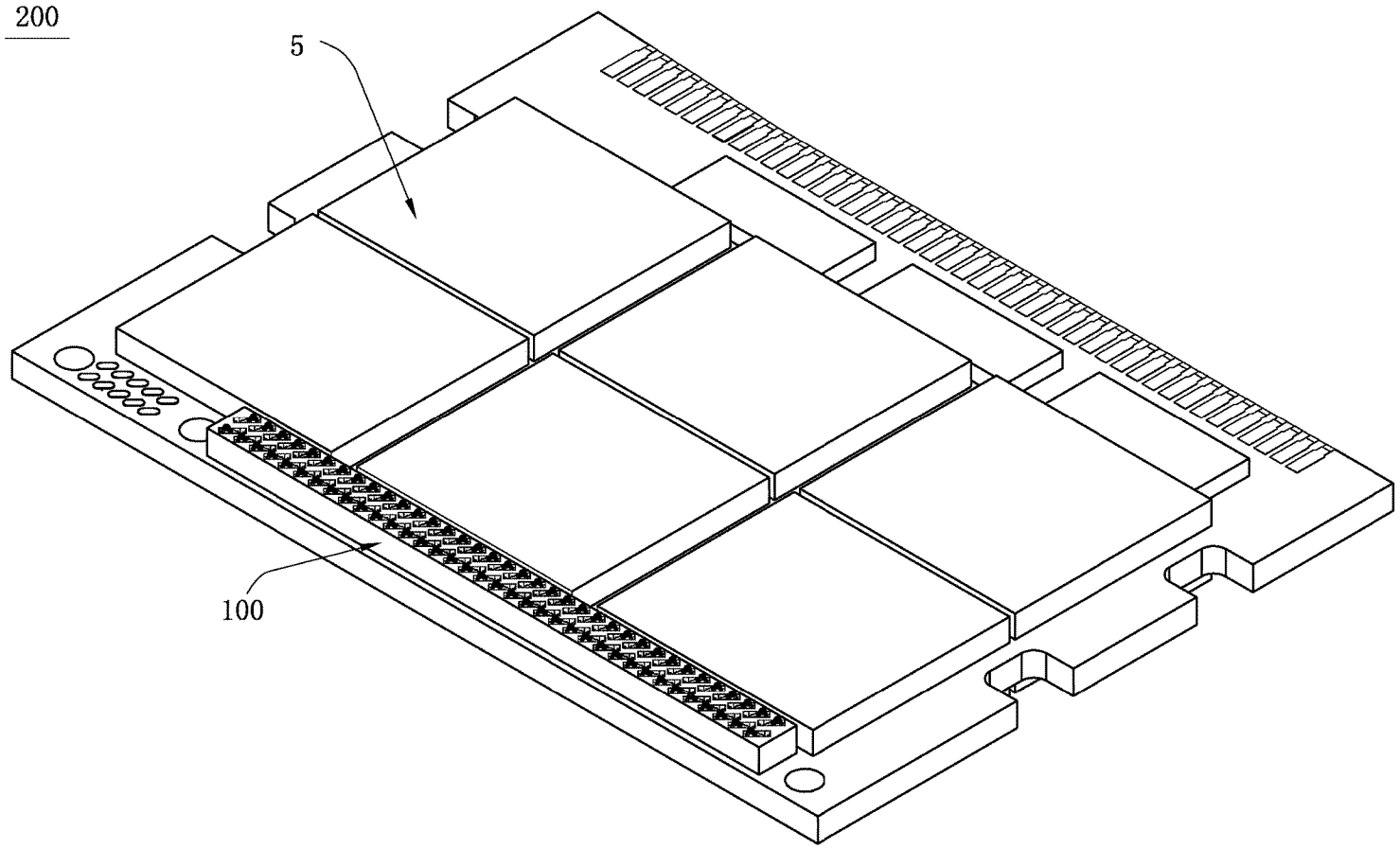
FIG. 16 is a schematic perspective view of an electrical device according to one embodiment of the present invention.

As shown in FIG. 15 and FIG. 16, the electrical connector 100 according to certain embodiments of the present invention may be further applied to an electronic device 200. The electronic device 200 includes an electronic card 5. The electrical connector 100 is installed to the electronic card 5, and the electrical connector 100 conductively connects the electronic card 5 to the electronic element 4.

To sum up, the electrical connector 100 according to certain embodiments of the present invention has the following beneficial effects:

(1) The width of the elastic arm 23 at the bending portion connecting the elastic arm 23 to the base portion 21 is less than or equal to the widths of the remaining parts of the elastic arm 23, so as to prevent the width of the elastic arm 23 at the bending portion connecting the elastic arm 23 to the base portion 21 from being excessively large, and ensure that the elastic arm 23 has good elastic performance at the bending portion connecting the elastic arm 23 to the base portion 21, thereby reducing the impedance of the terminal 2, and ensuring the signal conduction quality of the terminal 2. Additionally, the width of the contact portion 24 is greater than the width of the elastic arm 23 at the bending portion connecting the elastic arm 23 to the base portion 21, thereby increasing the area of the plate surface of the contact portion 24 and further increasing the contact area between the contact portion 24 and the mating element 3, so as to improve the stability of urging against the mating element 3 by the contact portion 24, and ensure the signal conduction quality of the terminal 2.

(2) The third elastic portion 253 urges against the second urging portion 28, and the third elastic portion 253 is not provided with the slot 201, thus increasing the structure stability of urging against the second urging portion 28 by the third elastic portion 253.

(3) A slot 201 runs through the first elastic portion 251, the second elastic portion 252 and the contact portion 24, so as to increase elasticity of the contact portion 24, the first elastic portion 251 and the second elastic portion 252, and further add a conductive path, thereby reducing the self-inductance phenomenon of the terminal 2 during signal transmission, and avoiding the crosstalk between neighboring terminals 2, which is favorable for improving the high-speed signal transmission of the terminal 2.

(4) Regardless of whether the mating element 3 is press-fit to the contact portion 24 to press and deform the elastic arm 23 and the bending arm 26, the second urging portion 28 is always being in contact with the third elastic portion 253, so as to ensure that the conductive path from the second urging portion 28 to the third elastic portion 253 is stable.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting a mating element to an electronic element, comprising:

an insulating body, provided with a plurality of accommodating holes; and a plurality of terminals, respectively and correspondingly accommodated in the accommodating holes, wherein each of the terminals has:

a base portion;

a strip connecting portion formed by extending vertically upward from the base portion, and configured to connect to a strip;

an elastic arm formed by bending in an upward direction and extending from the base portion;

a contact portion formed by bending and extending from the elastic arm, and configured to urge upward against the mating element, wherein a width of the contact portion is greater than a width of the elastic arm at a bending portion connecting the elastic arm to the base portion, the width of the elastic arm at the bending portion between the elastic arm and the base portion is less than or equal to the width of remaining portions of the elastic arm, and a first urging portion is formed by bending and extending from the contact portion; and a bending arm formed by bending in a downward direction and extending from the base portion, wherein the bending arm bends to form a conductive portion configured to be conductively connected to the electronic element, the conductive portion bends upward and extends to form a second urging portion, and the first urging portion urges against the second urging portion, wherein the first urging portion comprises a first elastic portion bending from the contact portion and obliquely extending downward and away from the base portion, a second elastic portion obliquely extending downward from the first elastic portion to be close to the base portion, and a third elastic portion bending and extending upward from the second elastic portion to be close to the base portion.

2. The electrical connector according to claim 1, comprising two strip connecting portions, wherein a top end of each of the two strip connecting portions is higher than the bending portion connecting the elastic arm to the base portion, and the elastic arm is formed by tearing and bending between the two strip connecting portions.

3. The electrical connector according to claim 1, wherein the base portion is of a vertical flat plate shape, and has a first section and a second section extending vertically upward from the first section, the first section is connected to the bending arm, the second section is connected to the elastic arm, and a width of the second section is greater than a width of the first section.

4. The electrical connector according to claim 1, wherein the bending arm comprises:

a lower positioning portion formed by bending and extending from the base portion toward a direction away from the conductive portion and then bending and extending reversely, wherein the lower positioning portion stops at a side surface of a corresponding one of the accommodating holes; and a connecting portion formed by extending obliquely downward from the lower positioning portion to be connected to the conductive portion.

5. The electrical connector according to claim 1, wherein when the mating element does not press-fit the contact portion, the first urging portion is in contact with the second urging portion.

6. The electrical connector according to claim 1, wherein a slot runs through the first elastic portion, the second elastic portion and the contact portion.

7. The electrical connector according to claim 6, wherein the third elastic portion is not provided with the slot, and the third elastic portion urges against the second urging portion.

8. The electrical connector according to claim 6, wherein the slot runs through the third elastic portion.

9. The electrical connector according to claim 6, wherein the slot further runs through the base portion and the elastic arm.

10. The electrical connector according to claim 6, wherein the slot does not extend to the elastic arm at the bending portion connecting the elastic arm to the base portion.

11. The electrical connector according to claim 1, wherein the elastic arm comprises:

an upper positioning portion formed by bending and extending from the base portion toward a direction away from the contact portion and then bending and extending reversely, wherein the upper positioning portion stops at a side surface of a corresponding one of the accommodating holes; and an extending portion formed by extending obliquely upward from the upper positioning portion to be connected to the contact portion.

12. The electrical connector according to claim 1, wherein the bending arm and the elastic arm are symmetrically disposed along a vertical direction, the conductive portion and the contact portion are symmetrically disposed along the vertical direction, and the second urging portion and the first urging portion are symmetrically disposed along the vertical direction.

13. The electrical connector according to claim 1, wherein each of two opposite sides of the base portion at a connection portion connecting the base portion to the bending arm is protrudingly provided with a protruding portion, and the protruding portion stops at a side surface of a corresponding one of the accommodating holes.

14. The electrical connector according to claim 1, wherein each of the accommodating holes is protrudingly formed with a stopping block, and the stopping block urges against a plate surface of the base portion.

15. An electrical device, comprising:

an electronic card; and the electrical connector according to claim 1, wherein the electrical connector is installed onto the electronic card.

* * * * *